US010274245B2

(12) United States Patent
Kaji et al.

(10) Patent No.: US 10,274,245 B2
(45) Date of Patent: Apr. 30, 2019

(54) HEAT EXCHANGE UNIT AND REFRIGERATION DEVICE

(71) Applicant: DAIKIN INDUSTRIES, LTD., Osaka-shi, Osaka (JP)

(72) Inventors: Ryuhei Kaji, Sakai (JP); Shun Yoshioka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 421 days.

(21) Appl. No.: 14/349,260

(22) PCT Filed: Oct. 4, 2012

(86) PCT No.: PCT/JP2012/075810

§ 371 (c)(1),
(2) Date: Apr. 2, 2014

(87) PCT Pub. No.: WO2013/051653

PCT Pub. Date: Apr. 11, 2013

(65) Prior Publication Data

US 2014/0250936 A1 Sep. 11, 2014

(30) Foreign Application Priority Data

Oct. 7, 2011 (JP) ..... 2011-223322

(51) Int. Cl.
*F25D 21/14* (2006.01)
*F25B 1/10* (2006.01)
(Continued)

(52) U.S. Cl.
CPC ..... *F25D 21/14* (2013.01); *F25B 1/10* (2013.01); *F25B 13/00* (2013.01); *F25B 39/00* (2013.01);
(Continued)

(58) Field of Classification Search
CPC .... F25B 2400/072; F25B 41/00; F25B 13/00; F25B 39/00; F25B 1/10; F25B 2309/061;
(Continued)

(56) References Cited

U.S. PATENT DOCUMENTS 810,030 A * 1/1906 Briscoe ..... F28F 1/128 165/152
858,258 A * 6/1907 Briscoe ..... B21B 15/0085 165/151
(Continued)

FOREIGN PATENT DOCUMENTS

CA 2368871 A1 * 8/2002 ..... B21D 53/085
DE 10 2004 019 668 A1 11/2004
(Continued)

OTHER PUBLICATIONS

International Preliminary Report of corresponding PCT Application No. PCT/JP2012/075810 dated Apr. 17, 2014.
(Continued)

*Primary Examiner* — Ljiljana V. Ciric
*Assistant Examiner* — Kirstin U Oswald
(74) *Attorney, Agent, or Firm* — Global IP Counselors, LLP

(57) ABSTRACT

A heat exchange unit includes a first heat exchanger, a second heat exchanger and a water guiding member. The first heat exchanger has a first heat exchange part exchanging heat between a refrigerant flowing in an interior and air passing an exterior. The second heat exchanger has a second heat exchange part disposed below the first heat exchange part and exchanging heat between the refrigerant flowing in an interior and air passing an exterior. The second heat exchanger is integrated with the first heat exchanger. The water guiding member is disposed between the first heat exchange part and the second heat exchange part and guides
(Continued)

condensation water generated on the first heat exchange part to the second heat exchange part. The heat exchange unit is preferably part of a refrigeration device that has a two element compression mechanism, an intermediate refrigerant pipe, and a switching mechanism.

8 Claims, 7 Drawing Sheets

(51) Int. Cl.

| | |
|---|---|
| ***F25B 39/00*** | (2006.01) |
| ***F28F 17/00*** | (2006.01) |
| ***F25B 13/00*** | (2006.01) |
| ***F25B 41/00*** | (2006.01) |
| ***F28D 1/04*** | (2006.01) |
| ***F28D 1/053*** | (2006.01) |
| ***F28F 1/12*** | (2006.01) |
| *F28F 27/02* | (2006.01) |
| *F25B 9/00* | (2006.01) |

(52) U.S. Cl.
CPC ..... *F25B 41/00* (2013.01); *F28D 1/0443* (2013.01); *F28D 1/05366* (2013.01); *F28F 1/128* (2013.01); *F28F 17/00* (2013.01); *F28F 17/005* (2013.01); *F25B 9/008* (2013.01); *F25B 2309/061* (2013.01); *F25B 2400/072* (2013.01); *F28F 27/02* (2013.01); *F28F 2215/00* (2013.01); *F28F 2215/12* (2013.01)

(58) Field of Classification Search
CPC ..... F25B 9/008; F25D 21/14; F28D 1/05366; F28D 1/0443; F28F 17/005; F28F 2215/12; F28F 1/128; F28F 17/00; F28F 2215/00
USPC ..... 62/510, 285, 324.5, 498, 513; 165/151–153, 173, 175
See application file for complete search history.

(56) References Cited

U.S. PATENT DOCUMENTS

| | | | | | |
|---|---|---|---|---|---|
| 2,410,180 | A * | 10/1946 | Perkins | F16N 39/02 | 165/134.1 |
| 2,902,264 | A * | 9/1959 | Schick | F01P 3/18 | 165/134.1 |
| 3,182,481 | A * | 5/1965 | Kinal | B21D 53/085 | 165/151 |
| 3,190,352 | A * | 6/1965 | Simpelaar | F28D 1/05383 | 138/110 |
| 3,239,002 | A * | 3/1966 | Young | F28F 1/02 | 138/172 |
| 3,306,071 | A * | 2/1967 | Holyfield | F24F 13/22 | 62/288 |
| 3,759,050 | A * | 9/1973 | Slaasted | F25B 39/02 | 165/111 |
| 3,771,595 | A * | 11/1973 | Slaasted | F28F 1/02 | 165/151 |
| 4,465,129 | A * | 8/1984 | Baldensperger | F28D 1/05383 | 165/153 |
| 4,519,214 | A * | 5/1985 | Sano | F25B 13/00 | 62/156 |
| 4,730,669 | A * | 3/1988 | Beasley | F28F 9/182 | 165/151 |
| 4,829,780 | A * | 5/1989 | Hughes | F25B 39/02 | 165/176 |
| 5,546,761 | A * | 8/1996 | Matsuo | F25B 39/04 | 165/173 |
| 6,405,559 | B1 * | 6/2002 | Yoneda | F25B 40/02 | 62/200 |
| 6,584,796 | B2 * | 7/2003 | Itoh | B60H 1/00907 | 62/159 |
| 6,658,882 | B2 * | 12/2003 | Ohama | F24F 13/06 | 415/208.1 |
| 6,931,881 | B1 * | 8/2005 | Movshovitz | F25B 39/04 | 62/279 |
| 2004/0237576 | A1 * | 12/2004 | Sasaki | B60H 1/00328 | 62/498 |
| 2005/0056049 | A1 * | 3/2005 | Sanada | F28D 1/0443 | 62/507 |
| 2005/0133207 | A1 * | 6/2005 | Scoville | F28D 1/0443 | 165/140 |
| 2005/0217839 | A1 * | 10/2005 | Papapanu | F28D 1/0443 | 165/185 |
| 2007/0137839 | A1 * | 6/2007 | Yamamoto | F28D 1/0443 | 165/140 |
| 2008/0163644 | A1 * | 7/2008 | Kadle | F25B 9/008 | 62/513 |
| 2008/0236184 | A1 * | 10/2008 | Morozumi | F04C 18/3442 | 62/324.6 |
| 2009/0044564 | A1 * | 2/2009 | Okamoto | F25B 1/10 | 62/510 |
| 2009/0266527 | A1 * | 10/2009 | Helms | F28D 1/0391 | 165/151 |
| 2010/0319369 | A1 * | 12/2010 | Fox | F25B 13/00 | 62/79 |
| 2011/0005269 | A1 * | 1/2011 | Fujimoto | F25B 1/10 | 62/510 |
| 2011/0139428 | A1 * | 6/2011 | Kim | F28F 1/128 | 165/181 |
| 2012/0011867 | A1 * | 1/2012 | Koons | F25B 39/04 | 62/115 |

FOREIGN PATENT DOCUMENTS

| | | | |
|---|---|---|---|
| JP | 3-13794 | A | 1/1991 |
| JP | 3-31693 | A | 2/1991 |
| JP | 2006-242432 | A | 9/2006 |
| JP | 2007-515613 | A | 6/2007 |
| JP | 2010-19534 | A | 1/2010 |
| JP | 2010-127506 | A | 6/2010 |
| JP | 2011-99664 | A | 5/2011 |
| WO | 03/106910 | A1 | 12/2003 |

OTHER PUBLICATIONS

European Search Report of corresponding EP Application No. 12 83 7854.4 dated Jan. 27, 2016.
International Search Report of corresponding PCT Application No. PCT/JP2012/075810.

* cited by examiner

HEAT EXCHANGE UNIT AND REFRIGERATION DEVICE

CROSS-REFERENCE TO RELATED APPLICATIONS

This U.S. National stage application claims priority under 35 U.S.C. § 119(a) to Japanese Patent Application No. 2011-223322, filed in Japan on Oct. 7, 2011, the entire contents of which are hereby incorporated herein by reference.

TECHNICAL HELD

The present invention relates to a heat exchange unit and a refrigeration device.

BACKGROUND ART

A variety of types of heat exchangers conventionally exist, such as the heat exchanger disclosed in JP-A 2011-99664. In the heat exchanger disclosed in JP-A 2011-99664, heat is exchanged between a refrigerant flowing in the interior and passing air passing the exterior.

SUMMARY

Technical Problem

Conventionally, a plurality of heat exchangers may be used in an integrated manner due to a manufacturing problem or the like. For example, if the heat exchanger size intended for use is relatively large so as to present a problem in terms of manufacturing work efficiency during manufacture, heat exchangers divided into a plurality may be arranged in the vertical direction and used as a single heat exchange unit.

However, when a plurality of heat exchangers are assembled, gaps are thought to form between each of the heat exchangers. Therefore, when the heat exchange unit is made to function as an evaporator, condensation water is likely to accumulate at a lower end portion of a heat exchanger disposed at higher position. When the accumulated condensation water turns into frost, there is a concern that the heat exchange efficiency of the heat exchange unit will decrease.

Accordingly, the present invention addresses the problem of providing a heat exchange unit and a refrigeration device in which drainage performance is improved.

Solution to Problem

A heat exchange unit according to a first aspect of the present invention includes a first heat exchanger, a second heat exchanger, and a water guiding member. The first heat exchanger has a first heat exchange part. The first heat exchange part exchanges heat between a refrigerant flowing in the interior and passing air passing the exterior. The second heat exchanger is integrated with the first heat exchanger and has a second heat exchange part. The second heat exchange part is disposed below the first heat exchange part and adapted for exchanging heat between the refrigerant flowing in the interior and passing air passing the exterior. The water guiding member is disposed between the first heat exchange part and the second heat exchange part and adapted for guiding condensation water generated in the first heat exchange part to the second heat exchange part.

Conventionally, when a plurality of heat exchangers are assembled and used as a single heat exchange unit due to a manufacturing problem or the like, a problem is presented in that gaps form between each of the heat exchangers, therefore making it more likely for condensation water to accumulate at a lower end portion of a heat exchanger disposed at a higher position. When the accumulated condensation water turns into frost, there is a concern that the heat exchange efficiency of the heat exchanger will decrease.

Therefore, in the present invention, a water guiding member is disposed between a first heat exchange part and a second heat exchange part disposed below the first heat exchange part. Condensation water generated on the first heat exchange part is thereby guided to the second heat exchange part. In other words, the condensation water can be guided downwards and thereby inhibited from accumulating at a lower end portion of the first heat exchange part. In other words, it is possible to improve drainage performance in the heat exchange unit and inhibit a decrease in the heat exchange efficiency of the first heat exchange part.

A heat exchange unit according to a second aspect of the present invention is the heat exchange unit according to the first aspect, wherein the first heat exchanger further has a first header connecting to both ends of the first heat exchange part and extending vertically. In addition, the second heat exchanger further has a second header connecting to both ends of the second heat exchange part and extending vertically. In addition, the first header and the second header are of different size.

Even in an instance, such as in the present invention, in which a plurality of heat exchangers are assembled and used as a heat exchange unit due to heads being of different size, since the water guiding member is disposed between the first heat exchange part and the second heat exchange part, it is possible to guide the condensation water generated in the first heat exchange part to the second heat exchange part, i.e., downwards, and improve drainage performance.

A heat exchange unit according to a third aspect of the present invention is the heat exchange unit according to the first or second aspects, wherein the water guiding member is a heat transfer fin.

In the present invention, using heat transfer fins such as those normally used in heat exchangers are used as water guiding members makes it possible to improve drainage performance in a simple manner. In addition, it is possible to further increase the heat transfer area and thereby improve the heat exchange efficiency in the heat exchange unit.

A heat exchange unit according to a fourth aspect of the present invention is the heat exchange unit according to any of first through third aspects of the present invention, wherein the first heat exchange part has a plurality of first flat pipes arranged vertically, and first heat transfer fins disposed between the first flat pipes. In addition, the second heat exchange part has a plurality of second flat pipes arranged vertically, and second heat transfer fins disposed between the second flat pipes. The water guide members are in contact with the first heat transfer fins and the second heat transfer fins.

In the present invention, the water guiding members are in contact with the first heat transfer fins and the second heat transfer fins, whereby condensation water generated in the first heat exchange part can be readily guided to the second heat exchange part, i.e., downwards.

A refrigeration device according to a fifth aspect of the present invention includes the heat exchange unit according to any of first through fourth aspects, a compression mechanism, an intermediate refrigerant pipe, and a switching mechanism. The compression mechanism has a first compression element for compressing the refrigerant and a second compression element for further compressing the refrigerant compressed by the first compression element. The intermediate refrigerant pipe is a pipe for causing the refrigerant compressed by the first compression element to be taken in by the second compression element. The switching mechanism switches a flow of the refrigerant compressed by the second compression element, and is thereby capable of switching between a cooling operation and a heating operation. The second heat exchanger is provided to the intermediate refrigerant pipe, functions during the cooling operation as a heat radiator for the refrigerant compressed in the first compression element and taken in by the second compression element, and functions during the heating operation as an evaporator for the refrigerant compressed by the second compression element. The first heat exchanger functions during the cooling operation as a heat radiator for the refrigerant compressed by the second compression element, and functions during the heating operation, with the second heat exchanger, as an evaporator for the refrigerant compressed by the second compression element.

There may be an instance in which, as in the present invention, the first heat exchanger and the second heat exchanger perform different tasks during a cooling operation, resulting in the density of the refrigerant at the outlet of the first heat exchanger and the density of the refrigerant at the outlet of the second heat exchanger being different. Therefore, a plurality of heat exchangers may be used as a single heat exchange unit. In the present invention, even under such a circumstance, the water guiding member being disposed makes it possible to improve the drainage performance.

Advantageous Effects of Invention

In the heat exchange unit according to the first aspect of the present invention, the drainage performance can be improved.

In the heat exchange unit according to the second aspect of the present invention, the drainage performance can be improved even in an instance in which a plurality of heat exchangers are assembled and used as a single heat exchange unit due to the heads being of different size.

In the heat exchange unit according to the third aspect of the present invention, the drainage performance can be improved in a simple manner.

In the heat exchange unit according to the fourth aspect of the present invention, the condensation water generated on the first heat exchange part can be more readily guided to the second heat exchange part.

In the refrigeration device according to the fifth aspect of the present invention, the drainage performance can be improved.

DESCRIPTION OF EMBODIMENT

An embodiment of an air-conditioning device will now be described with reference to the accompanying drawings as an example of a refrigeration device including a heat exchange unit 4 according to the present invention.

(1) Configuration of Air-conditioning Device 1

Figure 1:
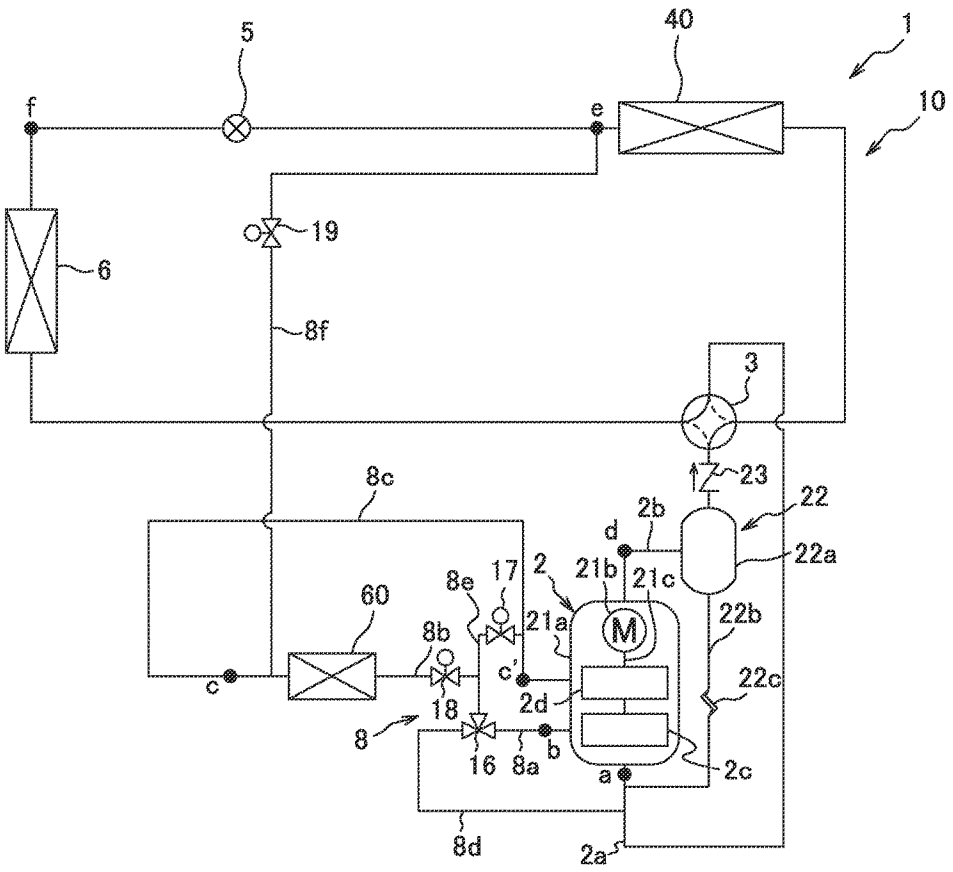
FIG. 1 is a schematic diagram of an air-conditioning device as an example of a refrigeration device including a heat exchange unit according to the present invention.

FIG. 1 is a schematic diagram of an air-conditioning device 1 as an example of a refrigeration device including the heat exchange unit 4 according to the present invention.

The air-conditioning device 1 is a device which has a refrigerant circuit 10 configured so as to be capable of switching between cooling operation and heating operation, and which performs a two-stage compression type refrigeration cycle using a refrigerant that works in the supercritical region (carbon dioxide in the present embodiment).

The refrigerant circuit 10 of the air-conditioning device 1 primarily has a compression mechanism 2, a switching mechanism 3, a heat exchange unit 4 (first heat exchanger 40 and second heat exchanger 60), an expansion mechanism 5, and a usage-side heat exchanger 6. Constituent elements of the refrigerant circuit 10 will now be described below.

(2) Constituent Elements of the Refrigerant Circuit 10

(2-1) The compression mechanism 2 comprises a compressor for performing two-stage compression on the refrigerant using two compression elements. The compression mechanism 2 has a sealed structure in which a compression mechanism driving motor 21*b*, a driving shaft 21*c*, a first compression element 2*c*, and a second compression element 2*d* are housed in a casing 21*a*. The compression mechanism driving motor 21*b* is connected to the driving shaft 21*c*. The driving shaft 21*c* is connected to the first compression element 2*c* and the second compression element 2*d*. In other words, the compression mechanism 2 has a "uniaxial two-stage compression structure" in which the first compression element 2*c* and the second compression element 2*d* are connected to the single driving shaft 21*c*, and the first compression element 2*c* and the second compression element 2*d* are both rotationally driven by the compression mechanism driving motor 21*b*. Each of the first compression element 2*c* and the second compression element 2*d* is a rotary-type, a screw-type, or another positive displacement-type compressive element. The compression mechanism 2 is configured to: take in a refrigerant from an intake pipe 2*a*; compressing, using the first compression element 2*c*, the refrigerant which has been taken in, and then discharging the refrigerant into an intermediate refrigerant pipe 8 (described further below); and causing the refrigerant discharged into the intermediate refrigerant pipe 8 to be taken in by the second compression element 2*d*, further compressing the refrigerant, and then discharging the refrigerant into a discharge pipe 2*b*. The intermediate refrigerant pipe 8 is a refrigerant pipe for causing the refrigerant, which has been compressed by and discharged from the first compression element 2*c* connected to the upstream side of the second compression element 2*d*, to be taken in by the second compression element 2*d* connected to the downstream side of the first compression element 2*c*. The discharge pipe 2*b* is a refrigerant pipe for sending the refrigerant discharged from the compression mechanism 2 to the first heat exchanger 40. The discharge pipe 2*b* is provided with an oil separation mechanism 22 and a check mechanism 23. The oil separation mechanism 22 is a mechanism for separating the refrigeration oil, which accompanies the refrigerant discharged from the compression mechanism 2, from the refrigerant and returning the refrigeration oil to the intake side of the compression mechanism 2, and primarily has: an oil separator 22*a* for separating, from the refrigerant, the refrigeration oil accompanying the refrigerant discharged from the compression mechanism 2; and an oil return pipe 22*b*, which is connected to the oil separator 22*a* and which returns the refrigeration oil separated from the refrigerant to the intake pipe 2*a* of the compression mechanism 2. The oil return pipe 22*b* is provided with a depressurization mechanism 22*c* for depressurizing the refrigeration oil flowing in the oil return pipe 22*b*. A capillary tube is used for the depressurization mechanism 22*c*. The check mechanism 23 is a mechanism for allowing the flow of the refrigerant from the discharge side of the compression mechanism 2 to the switching mechanism 3, and blocking the flow of the refrigerant from the switching mechanism 3 to the discharge side of the compression mechanism 2. A check value is used for the check mechanism 23.

As described above, the compression mechanism 2 has two compression elements 2*c*, 2*d*, and is configured so that the refrigerant is: compressed by the first compression element 2*c*, which is the more upstream element of the compression elements 2*c*, 2*d*; discharged; and further compressed by the second compression element 2*d* on the downstream side. The compression mechanism 2 is not limited to a single compression mechanism having a uniaxial two-stage compression structure as in the present embodiment, and may be a compression mechanism having a three-stage compression type or otherwise having more stages than a two-stage compression type. In addition, a multistage compression mechanism may be configured by serially connecting a plurality of compressors incorporating a single compression element and/or compressors incorporating a plurality of compression elements. It is also possible to use a parallel multistage compression-type compression mechanism in which two or more lines of multistage compression-type compressors are connected in parallel.

(2-2) Switching Mechanism 3

The switching mechanism 3 is a mechanism for switching the direction of refrigerant flow in the refrigerant circuit 10. The switching mechanism 3 is a four-way switch valve connected to the intake side of the compression mechanism 2, the discharge side of the compression mechanism 2, the first heat exchanger 40, and the usage-side heat exchanger 6. During a cooling operation, the switching mechanism 3 connects the discharge side of the compression mechanism 2 and one end of the first heat exchanger 40 to each other, and connects the intake side of the compression mechanism 2 and the usage-side heat exchanger 6 to each other, in order to cause the first heat exchanger 40 to function as a heat radiator for the refrigerant compressed by the compression mechanism 2, and to cause the usage-side heat exchanger 6 to function as an evaporator for the refrigerant which has been caused to release heat in the first heat exchanger 40 (see solid lines in the switching mechanism 3 in FIG. 1). During a heating operation, the switching mechanism 3 is capable of connecting the discharge side of the compression mechanism 2 and the usage-side heat exchanger 6 to each other and connecting the intake side of the compression mechanism 2 and one end of the first heat exchanger 40 to each other, in order to cause the usage-side heat exchanger 6 to function as a heat radiator for the refrigerant compressed by the compression mechanism 2, and to cause the first heat exchanger 40 to function as an evaporator for the refrigerant which has released heat in the usage-side heat exchanger 6 (see dotted lines in the switching mechanism 3 in FIG. 1). The switching mechanism 3 is not limited to a four-way switch valve, and may be configured so as to have a function of switching the direction of refrigerant flow as described by, e.g., combining a plurality of electromagnetic valves.

As described above, the switching mechanism 3 is configured so as to be capable of switching between a cooling operation and a heating operation by switching the direction of flow of the refrigerant compressed by the compression mechanism 2 (second compression element 2*d*).

(2-3) Heat Exchange Unit 4

The heat exchange unit 4 has a plurality of heat exchangers (first heat exchanger 40 and second heat exchanger 60 in the present embodiment). The heat exchange unit 4 exchanges heat between the refrigerant flowing in the interior and passing air A passing the exterior (see FIG. 4), and thereby functions as a heat radiator or an evaporator for the refrigerant. The first heat exchanger 40 and the second heat exchanger 60 are integrated. The first heat exchanger 40 and the second heat exchanger 60 will now be described.

(2-3-1) First Heat Exchanger 40

The first heat exchanger 40 functions as a heat radiator for the refrigerant compressed by the compression mechanism 2 (second compression element 2*d*) during a cooling operation, and functions as an evaporator for the refrigerant which has been compressed by the compression mechanism 2 (second compression element 2*d*) and caused to release heat in the usage-side heat exchanger 6 during a heating operation.

One end of the first heat exchanger 40 is connected to the switching mechanism 3, and the other end of the first heat exchanger 40 is connected to the expansion mechanism 5. A specific configuration of the first heat exchanger 40 will be described further below. The passing air passing the exterior of the first heat exchanger 40 is fed by a fan 50 (see FIG. 2). The fan 50 is driven by a fan-driving motor.

(2-3-2) Second Heat Exchanger 60

The second heat exchanger 60 is disposed below the first heat exchanger 40, and is provided to the intermediate refrigerant pipe 8. The second heat exchanger 60 is configured so that one end is connected to the first compression element 2*c* and the other end is connected to the second compression element 2*d*. During a cooling operation, the second heat exchanger 60 functions as a heat radiator for the refrigerant which is at an intermediate pressure in a refrigeration cycle and which is compressed by the first compression element 2*c* on the upstream side and taken in by the second compression element 2*d* on the downstream side, in order to improve the performance during a cooling operation. During a heating operation, the second heat exchanger 60 functions, together with the first heat exchanger 40, as an evaporator for the refrigerant which has been compressed by the second compression element 2*d* and caused to release heat in the usage-side heat exchanger 6, in order to improve the performance during a heating operation. A specific configuration of the second heat exchanger 60 will be described further below. The passing air passing the exterior of the second heat exchanger 60 is fed by a fan 50.

The intermediate refrigerant pipe 8 is further provided with a first electromagnetic valve 17, a second electromagnetic valve 18, and a three-way valve 16 functioning as a switching mechanism. The three-way valve 16 is a valve capable of switching between a first state of connecting the discharge side of the first compression element 2*c* and one end of the second heat exchanger 60, and a second state of connecting the intake side of the compression mechanism 2 (or more specifically, the intake side of the first compression element 2*c*) and one end of the second heat exchanger 60. The first electromagnetic valve 17 and the second electromagnetic valve 18 are valves that are controlled so as to open/close in order to cause the second heat exchanger 60 to function as a heat radiator for the refrigerant compressed by the first compression element 2*c* during a cooling operation only. The first electromagnetic valve 17 is provided to a fifth refrigerant pipe 8*e* described further below, and the second electromagnetic valve 18 is provided to a second refrigerant pipe 8*b* described further below.

The intermediate refrigerant pipe 8 has: a first refrigerant pipe 8*a* for connecting the discharge side of the first compression element 2*c* of the compression mechanism 2 and the three-way valve 16; the second refrigerant pipe 8*b* for connecting the three-way valve 16 and one end of the second heat exchanger 60 (refrigerant inlet side during a cooling operation); a third refrigerant pipe 8*c* for connecting the other end of the second heat exchanger 60 and the intake side of the second compression element 2*d* of the compression mechanism 2; a fourth refrigerant pipe 8*d* for connecting the three-way valve 16 and the intake pipe 2*a*; and a fifth refrigerant pipe 8*e* for providing a bypass from the second refrigerant pipe 8*b* to the third refrigerant pipe 8*c*.

In the present embodiment, in order to cause the second heat exchanger 60 to function as an evaporator during a heating operation, a return pipe 8*f* is provided on the side of the refrigerant inlet, during a heating operation, of the first heat exchanger 40. Specifically, the return pipe 8*f* is a refrigerant pipe capable of branching a part of the refrigerant flowing between the usage-side heat exchanger 6 and the first heat exchanger 40 and returning the refrigerant to the third refrigerant pipe 8*c*, and is configured so as to connect a portion between the expansion mechanism 5 and the first heat exchanger 40 with the third refrigerant pipe 8*c*. The return pipe 8*f* is provided with a return valve 19 which can be opened and closed.

(2-4) Expansion Mechanism 5

The expansion mechanism 5 is a mechanism for depressurizing the refrigerant, and an electric expansion valve is used. One end of the expansion mechanism 5 is connected to the heat exchange unit 40 and the other end of the expansion mechanism 5 is connected to the usage-side heat exchanger 6. During a cooling operation, the expansion mechanism 5 depressurizes the high-pressure refrigerant, which has been caused to release heat in the first heat exchanger 40, prior to sending the refrigerant to the usage-side heat exchanger 6. During a heating operation, the expansion mechanism 5 depressurizes the high-pressure refrigerant, which has been caused to release heat in the usage-side heat exchanger 6, prior to sending the refrigerant to the first heat exchanger 40.

(2-5) Usage-side Heat Exchanger 6

The usage-side heat exchanger 6 is a heat exchanger which may function as an evaporator or a heat radiator for the refrigerant. One end of the usage-side heat exchanger 6 is connected to the expansion mechanism 5 and the other end of the usage-side heat exchanger 6 is connected to the switching mechanism 3. Although not shown, the usage-side heat exchanger 6 is configured so that water and/or air, which functions as a heating source or a cooling source for exchanging heat with the refrigerant flowing in the usage-side heat exchanger 6, is supplied to the usage-side heat exchanger 6.

(3) Control Unit 9

Figure 2:
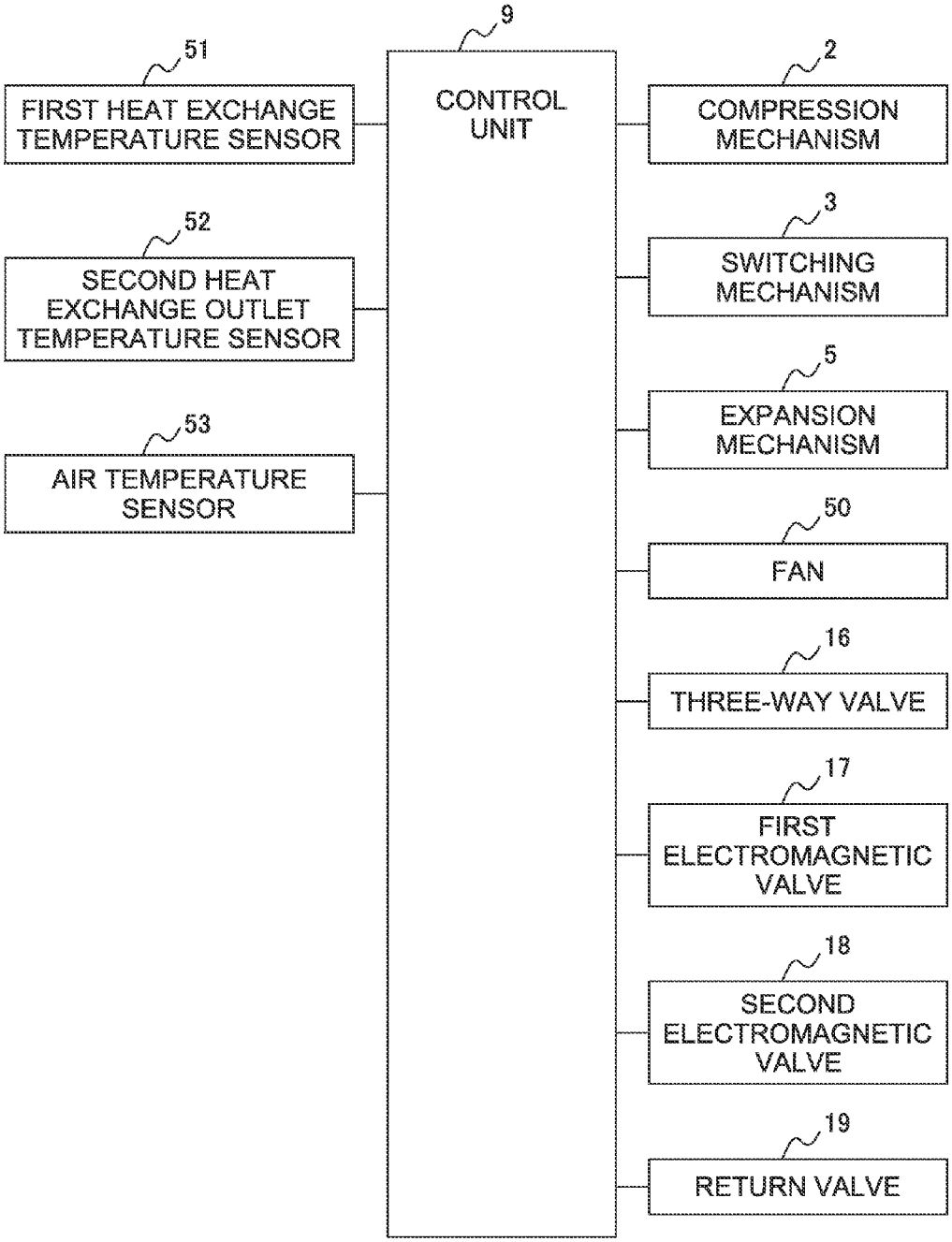
FIG. 2 is a control block diagram showing a control unit.

FIG. 2 is a control block diagram showing a control unit 9.

The air-conditioning device 1 has the control unit 9 for controlling the actuation of various parts constituting the air-conditioning device 1, such as the compression mechanism 2, the switching mechanism 3, the expansion mechanism 5, the fan 50, the three-way valve 16, the first electromagnetic valve 17, the second electromagnetic valve 18, and the return valve 19.

A variety of sensors provided to the air-conditioning device 1 are connected to the control unit 9. The variety of sensors may include, e.g., a first heat exchange temperature sensor 51, a second heat exchange outlet temperature sensor 52, and an air temperature sensor 53. The first heat exchange temperature sensor 51 is a sensor which is provided to the first heat exchanger 40 and which detects the temperature of the refrigerant flowing in the first heat exchanger 40. The second heat exchange outlet temperature sensor 52 is a sensor which is provided to the outlet of the second heat exchanger 60 and which detects the temperature of the refrigerant at the outlet of the second heat exchanger 60. The air temperature sensor 53 is a sensor which is provided to the main body of the air-conditioning device 1 and which detects the temperature of air functioning as a heat source for the first heat exchanger 40 and the second heat exchanger 60.

(4) Configuration of Heat Exchange Unit 4

Figure 3:
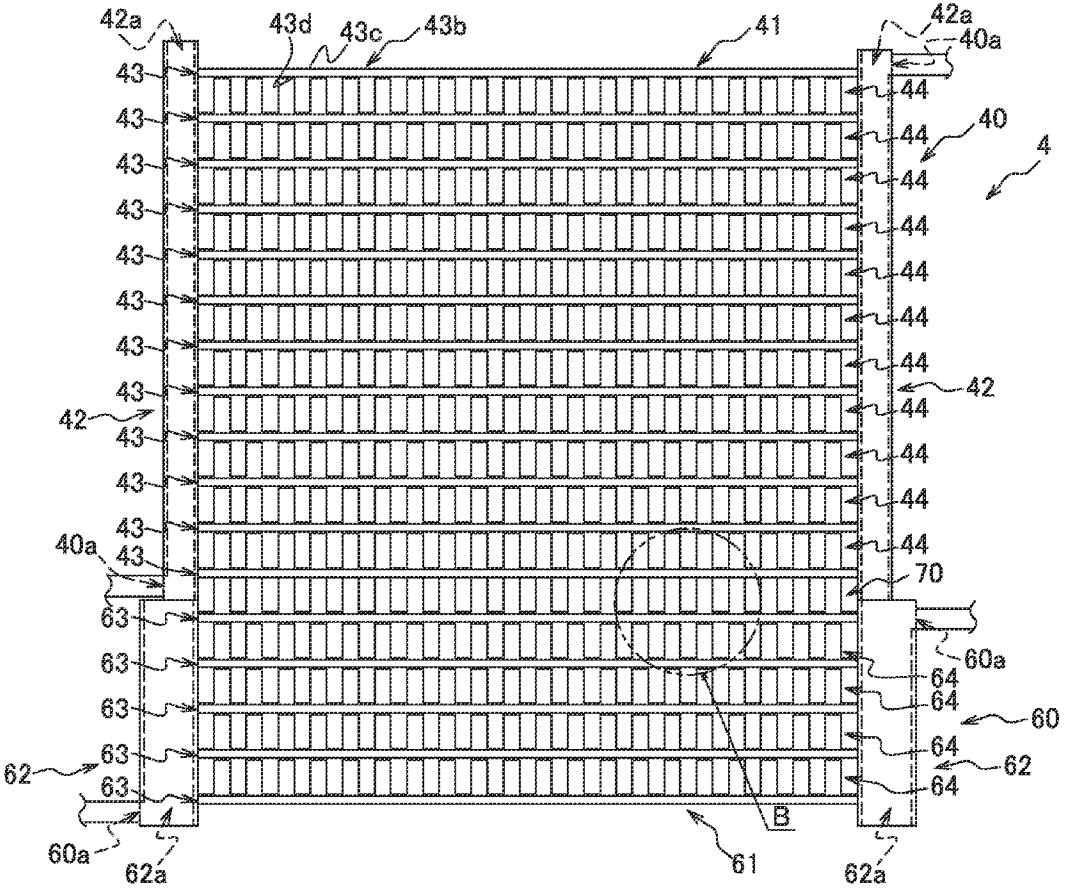
FIG. 3 is a schematic diagram showing the heat exchange unit.
Figure 4:
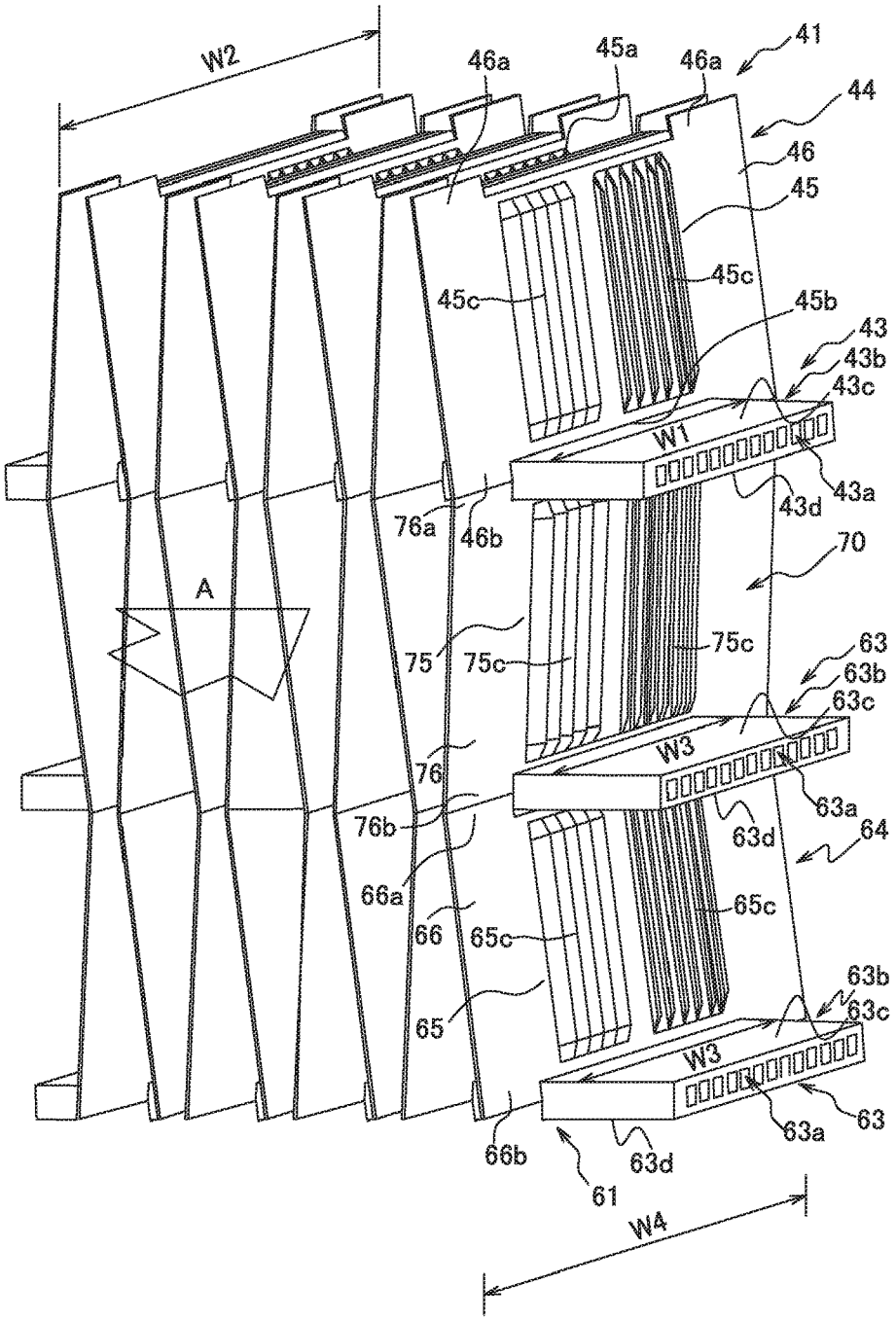
FIG. 4 is an expanded view of portion B in FIG. 3.

FIG. 3 is a schematic diagram showing the heat exchange unit 4. FIG. 4 is an expanded view of portion B in FIG. 3.

As shown in FIG. 3, the heat exchange unit 4 has a two-stage structure in which the second heat exchanger 60 is disposed below the first heat exchanger 40. The first heat exchanger 40 and the second heat exchanger 60 are integrated by first headers 42, 42 and second headers 62, 62 being connected by a header connection member (not shown). The configuration of the first heat exchanger 40 and the second heat exchanger 60 will now be described in more detail. The passing air A passing the exterior of the heat exchange unit 4 (the first heat exchanger 40 and the second heat exchanger 60) flows in a direction orthogonal to a longitudinal direction of a first heat exchange part 41 and a second heat exchange part 61 (more specifically, the direction heading away from the viewer perpendicularly with respect to the drawing in FIG. 3, and the direction indicated by an arrow in FIG. 4).

(4-1) First Heat Exchanger 40

The first heat exchanger 40 is a microchannel heat exchanger primarily having the first heat exchange part 41 for exchanging heat between the refrigerant flowing in the interior and air, and a pair of first headers 42, 42 connected to both ends, in the longitudinal direction (lateral direction in the drawing in FIG. 3), of the first heat exchange part 41, as shown in FIG. 3.

(4-1-1) First Heat Exchange Part 41

The first heat exchange part 41 has a plurality of first flat pipes 43 and first wave-shaped fins 44 disposed between the first flat pipes 43.

(4-1-1-1) First Flat Pipe 43

The first flat pipes 43 are pipe members made from a plate-shaped metal (e.g., aluminum or an aluminum alloy) extending so as to be elongated in a direction (more specifically, a horizontal direction) perpendicular to a longitudinal direction of the first headers 42, 42 (upright direction). The first flat pipes 43 are disposed so as to be arranged along the vertical direction (upright direction) so that large-width flat parts 43*b* extending in the horizontal direction are facing the vertical direction (upright direction) and a predetermined spacing is present between the first flat pipes 43. Each of the first flat pipes 43 has a plurality of refrigerant channel holes 43*a* for channeling the refrigerant formed so as to penetrate the first flat pipe 43 in a longitudinal direction thereof (horizontal direction) (see FIG. 4).

(4-1-1-2) First Wave-shaped Fin 44

The first wave-shaped fins 44 are heat transfer fins, made from a metal (e.g., aluminum or an aluminum alloy), having a wave-shaped profile. More specifically, each of the first wave-shaped fins 44 is configured by a plate-shaped member folded into a wave shape along the longitudinal direction of the first flat pipes 43 so that hill portions and valley portions are formed, the plate-shaped member having a greater width (W2) in the width direction (more specifically, a direction orthogonal, in the horizontal direction, to the longitudinal direction of the first flat pipes 43) than the width (W1) of the first flat pipes 43 in the width direction. The first wave-shaped fins 44 being disposed between the flat pipes secures a larger heat transfer area. Therefore, heat is exchanged in an efficient manner between the refrigerant flowing in the first flat pipes 43 (refrigerant channel holes 43*a*) and the passing air passing the exterior of the first heat exchange part 41.

Each of the first wave-shaped fins 44 is H-shaped when viewed along the longitudinal direction of the first flat pipes 43, and, as shown in FIG. 4, has a main fin body 45 and fin fringe parts 46.

The main fin body 45 is a portion disposed between the first flat pipes 43 (more specifically, between an upper surface 43*c*, which is an upper surface of the flat part 43*b* of a first flat pipe 43, and a lower surface 43*d*, which is a lower surface of the flat part 43*b* of a first flat pipe 43 vertically adjacent to the former first flat pipe 43). The main fin body 45 is fixed to the first flat pipe 43 so that an upper edge 45*a* of the hill portion is in contact with the lower surface 43*d* and a lower edge 45*b* of the valley portion is in contact with the upper surface 43*c*. The location of contact between the first flat pipe 43 and the main fin body 45 is bonded by brazing or a similar technique.

The main fin body 45 has a plurality of cut-and-raised portions 45*c* formed by cutting and raising a vertically central portion of the main fin body 45 in order to improve heat exchange efficiency. The cut-and-raised portions 45*c* are cut and raised to a louver shape, and formed so that a portion on the upstream side and a portion on the downstream side, with respect to the direction of flow of the passing air A, are inclined in opposite directions with respect to the direction of flow of the passing air A.

The fin fringe parts 46 are portions that protrude outwards with respect to the width direction of the first flat pipes 43 (more specifically, in both widthwise outward directions) from the main fin body 45. The height position of an upper edge of an upper edge part 46*a* of each of the fin fringe parts 46 is higher than the lower surface 43*d* of the first flat pipe 43, and the height position of a lower edge of a lower edge part 46*b* of each of the fin fringe parts 46 is lower than the upper surface 43*c* of the first flat pipe 43. This is achieved by forming, in advance, incisions along the width direction at both widthwise edge parts of the plate-shaped member, whereby only the main fin body 45 is folded when the plate-shaped member is folded to a wave shape and the first wave-shaped fins 44 are formed. In other words, the above incisions are formed in advance in the plate-shape member, whereby the upper edge part 46*a* and the lower edge part 46*b* of each of the fin fringe parts 46 are kept in a cut and raised state without being folded. The upper edge of the upper edge part 46*a* and the lower edge of the lower edge part 46*b* of each of the fin fringe parts 46 are configured so as to extend in the horizontal direction.

In the present embodiment, the first wave-shaped fins 44 are configured so that the fin fringe parts 46 of vertically adjacent first wave-shaped fins 44 are in contact with each other (more specifically, so that the upper edges of the upper edge parts 46*a* of a fin fringe part 46 are in contact with the lower edges of the lower edge parts 46*b* of another fin fringe part 46).

(4-1-2) First Headers 42, 42

The pair of first headers 42, 42 are disposed so as to be set apart from each other and so that each of the first headers 42, 42 extends in the upright direction. Each of the first headers 42 is a metal (more specifically, aluminum, an aluminum alloy, or the like) member having a cylindrical shape in which upper and lower ends are closed.

An opening 40*a* for causing the refrigerant to flow into the first heat exchanger 40 or causing the refrigerant to flow out from the first heat exchanger 40 is formed at a lower portion of one of the first headers 42, 42 and an upper portion of the other first header 42. A refrigerant channel 42*a* which communicates with the opening 40*a* and which channels the refrigerant is formed in the first header 42. The refrigerant channel 42*a* is formed so that the refrigerant flows in the vertical direction, and communicates with the refrigerant channel holes 43*a* formed in the first flat pipes 43.

(4-1-3) Flow of Refrigerant in the First Heat Exchanger 40

During a cooling operation (in an instance in which the first heat exchanger 40 functions as a heat radiator for the refrigerant), the refrigerant flows from the first header 42 on the right side of the drawing in FIG. 3 (referred to herein as a first right side header in order to facilitate description) to the first header 42 on the left side of the drawing in FIG. 3 (referred to as a first left side header in order to facilitate description). Specifically, the high-pressure refrigerant discharged from the compression mechanism 2 flows through the opening 40*a* of the first right side header into the refrigerant channel 42*a* of the first right side header. The refrigerant, which has flowed into the refrigerant channel 42*a* of the first right side header, is split between the first flat pipes 43, apportioned between the refrigerant channel holes 43*a* formed in the first flat pipes 43, and caused to flow into the refrigerant channel 42*a* formed in the first left side header. The high-pressure refrigerant exchanges heat with the passing air passing the exterior, and is thereby caused to release heat and cooled. The refrigerant which has flowed into the refrigerant channel 42*a* of the first left side header flows through the opening 40*a* formed in the first left side header to the expansion mechanism 5.

Meanwhile, during a heating operation (when the first heat exchanger 40 functions as an evaporator for the refrigerant), the refrigerant flows from the first left side header to the first right side header. Specifically, the low-pressure refrigerant in a gas-liquid two-phase state, which has flowed from the expansion mechanism 5, flows into the refrigerant channel 42*a* of the first left side header through the opening 40*a* of the first left side header. The refrigerant, which has flowed into the refrigerant channel 42*a* of the first left side header, is split between the first flat pipes 43, apportioned between the refrigerant channel holes 43*a* formed in the first flat pipes 43, and caused to flow into the refrigerant channel

42*a* formed in the first right side header. The low-pressure refrigerant in a gas-liquid two-phase state exchanges heat with the passing air passing the exterior, and is thereby heated and caused to evaporate. The refrigerant which has flowed into the refrigerant channel 42*a* of the first right side header flows through the opening 40*a* formed in the first right side header back to the compression mechanism 2.

Thus, the refrigerant flowing in the first heat exchanger 40 flows from above to below during a cooling operation and flows from below to above during a heating operation.

(4-2) Second Heat Exchanger 60

As shown in FIG. 3, the second heat exchanger 60 is a microchannel heat exchanger primarily having a second heat exchange part 61 for exchanging heat between the refrigerant flowing in the interior and the passing air A passing the exterior, and a pair of second headers 62, 62 connected to both ends of the second heat exchange part 61.

(4-2-1) Second Heat Exchange Part 61

The second heat exchange part 61 has a plurality of second flat pipes 63 and second wave-shaped fins 64 disposed between the second flat pipes 63.

(4-2-1-1) Second Flat Pipe 63

The second flat pipes 63 are pipe members made from a plate-shaped metal (e.g., aluminum or an aluminum alloy) extending so as to be elongated in a direction (more specifically, a horizontal direction) perpendicular to a longitudinal direction of the second headers 62, 62 (upright direction). The second flat pipes 63 are disposed so as to be arranged along the vertical direction (upright direction) so that large-width flat parts 63*b* extending in the horizontal direction are facing the vertical direction (upright direction) and a predetermined spacing is present between the second flat pipes 63. Each of the second flat pipes 63 has a plurality of refrigerant channel holes 63*a* for channeling the refrigerant formed so as to penetrate the second flat pipe 63 in a longitudinal direction thereof (horizontal direction) (see FIG. 4).

(4-2-1-2) Second Wave-Shaped Fin 64

The second wave-shaped fins 64 are heat transfer fins, made from a metal (e.g., aluminum or an aluminum alloy), having a wave-shaped profile. More specifically, each of the second wave-shaped fins 64 is configured by a plate-shaped member folded into a wave shape along the longitudinal direction of the second flat pipes 63 so that hill portions and valley portions are formed, the plate-shaped member having a greater width (W4) in the width direction (more specifically, a direction orthogonal, in the horizontal direction, to the longitudinal direction of the second flat pipes 63) than the width (W3) of the second flat pipes 63 in the width direction. The second wave-shaped fins 64 being disposed between the flat pipes secures a larger heat transfer area. Therefore, heat is exchanged in an efficient manner between the refrigerant flowing in the second flat pipes 63 (refrigerant channel holes 63*a*) and the passing air passing the exterior of the second heat exchange part 61.

Each of the second wave-shaped fins 64 has, as shown in FIG. 4, a main fin body 65 and fin fringe parts 66.

The main fin body 65 is a portion disposed between the second flat pipes 63 (more specifically, between an upper surface 63*c*, which is an upper surface of the flat part 63*b* of a second flat pipe 63, and a lower surface 63*d*, which is a lower surface of the flat part 63*b* of a second flat pipe 63 vertically adjacent to the former second flat pipe 63). The main fin body 65 is fixed to the second flat pipe 63 so that an upper edge 65*a* of the hill portion is in contact with the lower surface 63*d* and a lower edge 65*b* of the valley portion is in contact with the upper surface 63*c*. The location of contact between the second flat pipe 63 and the main fin body 65 is bonded by brazing or a similar technique.

The main fin body 65 has a plurality of cut-and-raised portions 65*c* formed by cutting and raising a vertically central portion of the main fin body 65 in order to improve heat exchange efficiency. The cut-and-raised portions 65*c* are cut and raised to a louver shape, and formed so that a portion on the upstream side and a portion on the downstream side, with respect to the direction of flow of the passing air A, are inclined in opposite directions with respect to the direction of flow of the passing air A.

The fin fringe parts 66 are portions that protrude outwards with respect to the width direction of the second flat pipes 63 (more specifically, in both widthwise outward directions) from the main fin body 65. The height position of an upper edge of an upper edge part 66*a* of each of the fin fringe parts 66 is higher than the lower surface 63*d* of the second flat pipe 63, and the height position of a lower edge of a lower edge part 66*b* of each of the fin fringe parts 66 is lower than the upper surface 63*c* of the second flat pipe 63. This is achieved by forming, in advance, incisions along the width direction at both widthwise edge parts of the plate-shaped member, whereby only the main fin body 65 is folded when the plate-shaped member is folded to a wave shape and the second wave-shaped fins 64 are formed. In other words, the above incisions are formed in advance in the plate-shape member, whereby the upper edge part 66*a* and the lower edge part 66*b* of each of the fin fringe parts 66 are kept in a cut and raised state without being folded. The upper edge of the upper edge part 66*a* and the lower edge of the lower edge part 66*b* of each of the fin fringe parts 66 are configured so as to extend in the horizontal direction.

In the present embodiment, the second wave-shaped fins 64 are configured so that the fin fringe parts 66 of vertically adjacent second wave-shaped fins 64 are in contact with each other (more specifically, so that the upper edges of the upper edge parts 66*a* of a fin fringe part 66 are in contact with the lower edges of the lower edge parts 66*b* of another fin fringe part 66).

In the present embodiment, the first flat pipes 43 of the first heat exchanger 40 and the second flat pipes 63 of the second heat exchanger 60, and the first wave-shaped fins 44 of the first heat exchanger 40 and the second wave-shaped fins 64 of the second heat exchanger 60 have the same configuration. Therefore, width W1 and width W3 are identical, and width W2 and width W4 are identical.

(4-2-2) Second Headers 62, 62

The pair of second headers 62, 62 are disposed so as to be set apart from each other and so that each of the second headers 62, 62 extends in the upright direction. Each of the second headers 62, 62 is a metal (more specifically, aluminum, an aluminum alloy, or the like) member having a cylindrical shape in which upper and lower ends are closed.

An opening 60*a* for causing the refrigerant to flow into the second heat exchanger 60 or causing the refrigerant to flow out from the second heat exchanger 60 is formed at a lower portion of one of the second headers 62, 62 and an upper portion of the other second header 62. A refrigerant channel 62*a* which communicates with the opening 60*a* and which channels the refrigerant is formed in the second header 62. The refrigerant channel 62*a* is formed so that the refrigerant flows in the vertical direction, and communicates with the refrigerant channel holes 63*a* formed in the second flat pipes 63.

(4-2-3) Flow of Refrigerant in the Second Heat Exchanger 60

During a cooling operation (in an instance in which the second heat exchanger 60 functions as a heat radiator for the refrigerant), the refrigerant flows from the second header 62 on the right side of the drawing in FIG. 3 (referred to herein as a second right side header in order to facilitate description) to the second header 62 on the left side of the drawing in FIG. 3 (referred to as a second left side header in order to facilitate description). Specifically, the intermediate-pressure refrigerant discharged from the first compression element 2*c* on the upstream side of the compression mechanism 2 flows through the opening 60*a* of the second right side header into the refrigerant channel 62*a* of the second right side header. The refrigerant, which has flowed into the refrigerant channel 62*a* of the second right side header, is split between the second flat pipes 63, apportioned between the refrigerant channel holes 63*a* formed in the second flat pipes 63, and caused to flow into the refrigerant channel 62*a* formed in the second left side header. The intermediate-pressure refrigerant exchanges heat with the passing air passing the exterior, and is thereby caused to release heat and cooled. The refrigerant which has flowed into the refrigerant channel 62*a* of the second left side header flows through the opening 60*a* formed in the second left side header to the second compression element 2*d* on the downstream side.

Meanwhile, during a heating operation (when the second heat exchanger 60 functions as an evaporator for the refrigerant), the refrigerant flows from the second left side header to the second right side header. Specifically, the low-pressure refrigerant in a gas-liquid two-phase state, which has flowed through the return pipe 8*f* from the expansion mechanism 5, flows into the refrigerant channel 62*a* of the second left side header through the opening 60*a* of the second left side header. The refrigerant, which has flowed into the refrigerant channel 62*a* of the second left side header, is split between the second flat pipes 63, apportioned between the refrigerant channel holes 63*a* formed in the second flat pipes 63, and caused to flow into the refrigerant channel 62*a* formed in the second right side header. The low-pressure refrigerant in a gas-liquid two-phase state exchanges heat with the passing air passing the exterior, and is thereby caused to evaporate. The refrigerant which has flowed into the refrigerant channel 62*a* of the second right side header flows through the opening 60*a* formed in the second right side header back to the compression mechanism 2.

Thus, the refrigerant flowing in the second heat exchanger 60 flows from above to below during a cooling operation and flows from below to above during a heating operation.

In the present embodiment, the inside diameter of the second header 62 (i.e., the diameter of a refrigerant channel-forming part forming the refrigerant channel 62*a*) is set so as to be greater than the inside diameter of the first header 42 (i.e., the diameter of a refrigerant channel-forming part forming the refrigerant channel 42*a*). In other words, the first headers 42 and the second headers 62 are designed so that they are of different size.

This is because, as described above, the first heat exchanger 40 and the second heat exchanger 60 perform different tasks during a cooling operation. Specifically, during a cooling operation, the density of the refrigerant at the outlet of the first heat exchanger 40 (i.e., the refrigerant that has flowed out to the exterior from the first left side header) is about four times higher than the density of the refrigerant at the outlet of the second heat exchanger 60 (i.e., the refrigerant that has flowed out to the exterior from the second left side header). Therefore, the inside diameter of the second header 62 is set so as to be larger than the inside diameter of the first header 42 in order to reduce the loss of pressure of the refrigerant.

(5) Water Guiding Fin 70

In the present embodiment, as described above, the first headers 42, 42 of the first heat exchange part 41 and the second headers 62, 62 are of different size (more specifically, have different inside diameters). There may be instances in which a plurality of heat exchangers are assembled and used as a single heat exchange unit due to the density of the refrigerant passing through the respective heat exchangers being different as described above. However, when a plurality of heat exchangers are arranged in the vertical direction and used as a single heat exchange unit, a gap is formed between the heat exchangers (in the present embodiment, between the first heat exchange part of the first heat exchanger and the second heat exchange part of the second heat exchanger).

During a heating operation (i.e., when the first heat exchanger and the second heat exchanger are caused to function as evaporators for the refrigerant), condensation water may be generated on the surface of the first heat exchanger and the second heat exchanger by air passing the exterior of the first heat exchanger and the second heat exchanger losing heat to the refrigerant flowing through the interior of the flat pipes.

Therefore, when there is a gap between the first heat exchanger and the second heat exchanger, the condensation water generated on the first heat exchanger may flow downwards and accumulate at a lower end portion of the first heat exchanger. When the condensation water is cooled further, turns into frost, and adheres to the surface of the lower end portion of the first heat exchanger, there is a concern that the heat exchange efficiency of the first heat exchanger will decrease.

Therefore, the heat exchange unit 4 of the present embodiment has, in addition to the first heat exchanger 40 and the second heat exchanger 60, water guiding fins 70 functioning as water guiding members for guiding condensation water generated on the first heat exchange part 41 to the second heat exchange part 61 and further to a condensation water storage part (not shown) for storing the condensation water, located below the second heat exchange part 61.

The water guiding fins 70 are thermally conductive heat transfer fins disposed between the first heat exchange part 41 and the second heat exchange part 61. In the present embodiment, the same fins as those used as the wave-shaped fins 44, 64 in the first heat exchanger 40 and the second heat exchanger 60 are used for the water guiding fins 70. Specifically, each of the water guiding fins 70 has: a main fin body 75 disposed between the first flat pipe 43 disposed at the lowermost level from among the plurality of the first flat pipes 43 and the second flat pipe 63 disposed at the uppermost level from among the plurality of the second flat pipes 63 (more specifically, between the lower surface 43*d* of the first flat pipe 43 disposed at the lowermost level of the first heat exchange part 41 and the upper surface 63*c* of the second flat pipe 63 disposed at the uppermost level of the second heat exchange part 61); and fin fringe parts 76 protruding in both outward directions with respect to the width direction of the flat pipes 43, 63. The main fin body 75 has a plurality of cut-and-raised portions 75*c* formed by cutting and raising a vertically center portion of the main fin body 75 in order to improve heat exchange efficiency.

In the present embodiment, disposing the water guiding fins 70 between the first heat exchange part 41 and the second heat exchange part 61 makes it possible to fill the gap between the first heat exchange part 41 and the second heat exchange part 61. In addition, it becomes possible to more readily guide the condensation water generated on the first heat exchange part 41 downwards.

Since the water guiding fins 70 have the same configuration as that of the wave-shaped fins 44, 64, an upper edge of an upper edge part 76*a* of each of the fin fringe parts 76 of the water guiding fins 70 is positioned higher than the lower surface 43*d* of the first flat pipe 43, and a lower edge of a lower edge part 76*b* of each of the fin fringe parts 76 is positioned lower than the upper surface 63*c* of the second flat pipe 63. Specifically, each of the water guiding fins 70 can be positioned so as to be in contact with a first wave-shaped fin 44 of the first heat exchanger 40 (more specifically, the first wave-shaped fin 44 positioned at the lowermost level) and a second wave-shaped fin 64 of the second heat exchanger 60 (more specifically, the second wave-shaped fin 64 positioned at an uppermost level). More specifically, each of the water guiding fins 70 can be disposed so that the upper edge of the upper edge part 76*a* of each of the fin fringe parts 76 of the water guiding fin 70 is in contact with the lower edge of the lower edge part 46*b* of each of the fin fringe parts 46 of the first wave-shaped fin 44 disposed at the lowermost level from among the first wave-shaped fins 44, and so that the lower edge of the lower edge part 76*b* of each of the fin fringe parts 76 of the water guiding fin 70 is in contact with the upper edge of the upper edge part 66*a* of each of the fin fringe parts 66 of the second wave-shaped fin 64 disposed at the uppermost level from among the second wave-shaped fins 64. It thereby becomes possible to more readily guide the condensation water generated on the first heat exchange part 41 downwards. In addition, since the water guiding fins 70 are heat transfer fins, the heat transfer area can be increased and the performance can be improved.

In the present embodiment, thus using, for the water guiding members, similar fins as those used as the wave-shaped fins 44, 64 in the first heat exchanger 40 and the second heat exchanger 60 makes it possible to guide the condensation water downwards in a simple manner.

(6) Actuation of the Air-conditioning Device 1

Figure 5:
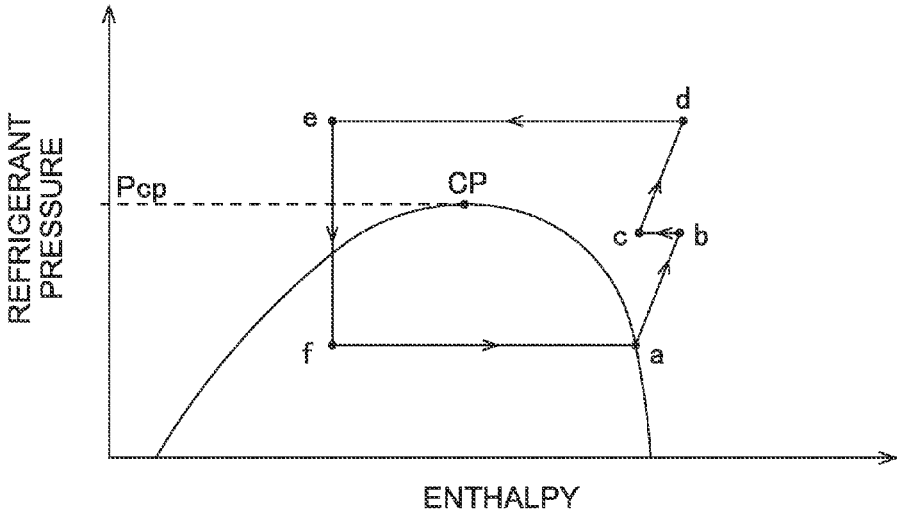
FIG. 5 is a refrigerant pressure-enthalpy diagram showing a refrigeration cycle during a cooling operation.
Figure 6:
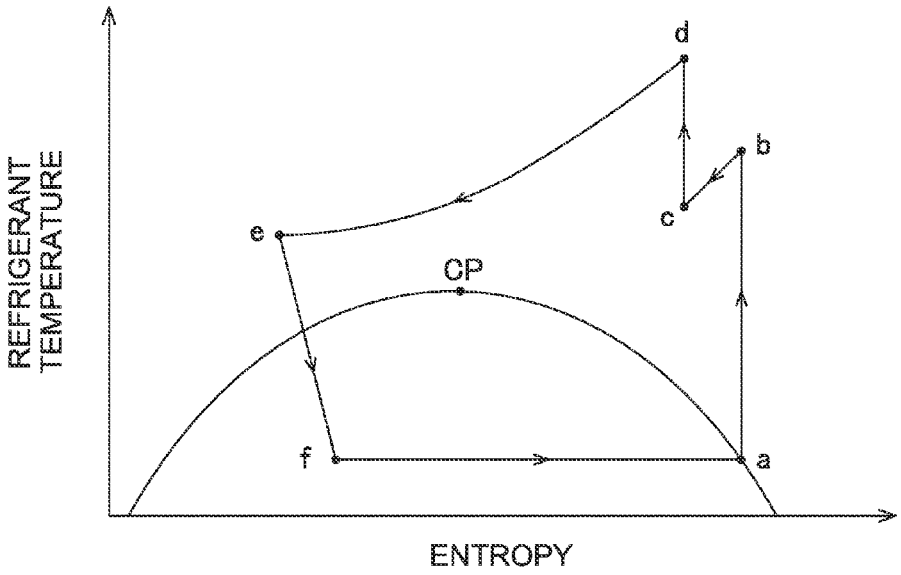
FIG. 6 is a refrigerant temperature-entropy diagram showing the refrigeration cycle during a cooling operation.
Figure 7:
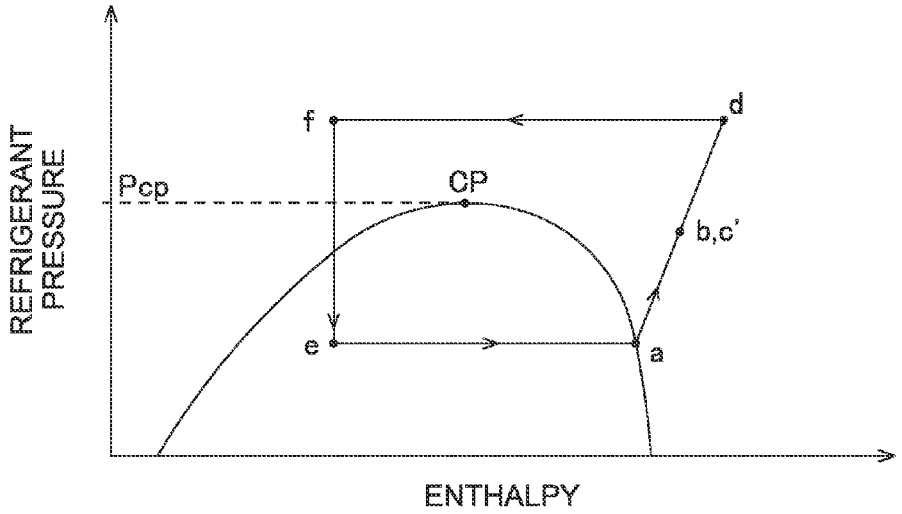
FIG. 7 is a refrigerant pressure-enthalpy diagram showing a refrigeration cycle during a heating operation.
Figure 8:
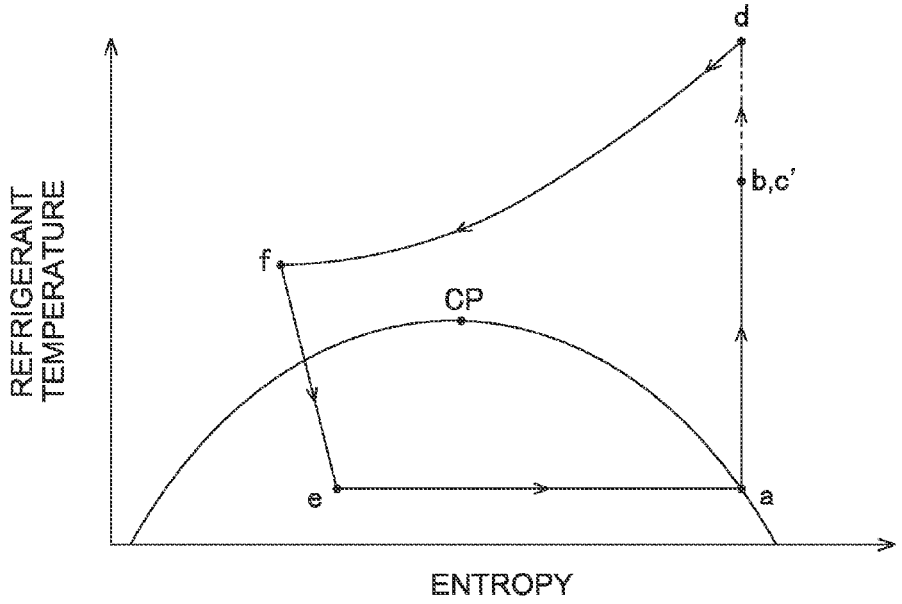
FIG. 8 is a refrigerant temperature-entropy diagram showing the refrigeration cycle during a heating operation.

FIG. 5 is a refrigerant pressure-enthalpy diagram showing a refrigeration cycle during a cooling operation. FIG. 6 is a refrigerant temperature-entropy diagram showing the refrigeration cycle during a cooling operation. FIG. 7 is a refrigerant pressure-enthalpy diagram showing a refrigeration cycle during a heating operation. FIG. 8 is a refrigerant temperature-entropy diagram showing the refrigeration cycle during a heating operation.

The actuation of the air-conditioning device 1 will now be described with reference to FIGS. 1 and 5-8. Operation control for the cooling operation and heating operation below is performed by the abovementioned control unit 9. In the following description, "high pressure" represents the high pressure in the refrigeration cycle (i.e., the pressure at points d and e in FIGS. 5 and 6 or the pressure at points d and f in FIGS. 7 and 8), "low pressure" represents the low pressure in the refrigeration cycle (i.e., the pressure at points a and f in FIGS. 5 and 6 and the pressure at points a and e at FIGS. 7 and 8), and "intermediate pressure" represents the intermediate pressure in the refrigeration cycle (i.e., the pressure at points b and c in FIGS. 5 and 8).

(6-1) Cooling Operation

During a cooling operation, the switching mechanism 3 is controlled to the state represented by solid lines in FIG. 1. The three-way valve 16 is controlled to the first state. The expansion mechanism 5 is subjected to an opening degree adjustment. The second electromagnetic valve 18 is controlled to an open state. The first electromagnetic valve 17 and the return valve 19 are controlled to a closed state.

When the compression mechanism 2 is driven with the refrigerant circuit 10 being in the state described above, the low-pressure refrigerant (see point a in FIGS. 1, 5 and 6) is taken in from the intake pipe 2*a* by the compression mechanism 2, first compressed to an intermediate pressure by the first compression element 2*c* on the upstream side, and then discharged into the intermediate refrigerant pipe 8 (more specifically, the first refrigerant pipe 8*a*) (see point b in FIGS. 1, 5 and 6). The intermediate-pressure refrigerant discharged from the first compression element 2*c* is sent, via the three-way valve 16 and the second refrigerant pipe 8*b*, to the second heat exchanger 60. The intermediate-pressure refrigerant sent to the second heat exchanger 60 is, in the second heat exchanger 60, caused to release heat and cooled by exchanging heat with air functioning as a cooling source and passing the exterior (see point c in FIGS. 1, 5 and 6). The refrigerant cooled in the second heat exchanger 60 is taken in, via the third refrigerant pipe 8*c*, by the second compression element 2*d* connected to the downstream side of the first compression element 2*c*, and further compressed. The high-pressure refrigerant compressed by the second compression element 2*d* is discharged from the compression mechanism 2 to the discharge pipe 2*b* (see point d in FIGS. 1, 5 and 6). The high-pressure refrigerant discharged from the compression mechanism 2 is compressed, by a two-stage compression actuation in the compression elements 2*c*, 2*d*, to a pressure exceeding critical pressure (i.e., critical pressure Pcp at critical point CP shown in FIG. 5). In addition, the high-pressure discharged from the compression mechanism 2 flows into the oil separator 22*a* constituting the oil separation mechanism 22, and accompanying refrigeration oil is separated. The refrigeration oil separated from the high-pressure refrigerant in the oil separator 22*a* is caused to flow into the oil return pipe 22*b* constituting the oil separation mechanism 22, depressurized in the depressurization mechanism 22*c* provided to the oil return pipe 22*b*, then returned to the intake pipe 2*a* of the compression mechanism 2, and then taken back in to the compression mechanism 2. The high-pressure refrigerant discharged from the compression mechanism 2 is sent through the check mechanism 23 and the switching mechanism 3 to the first heat exchanger 40 functioning as a heat radiator for the refrigerant. The high-pressure refrigerant sent to the first heat exchanger 40 is caused to exchange heat with air functioning as a cooling source and passing the exterior, caused to release heat, and cooled, in the first heat exchanger 40 (see point e in FIGS. 1, 5 and 6). The high-pressure refrigerant cooled in the first heat exchanger 40 is depressurized in the expansion mechanism 5 and turned into a low-pressure refrigerant in a gas-liquid two-phase state, and sent to the usage-side heat exchanger 6 functioning as an evaporator for the refrigerant (see point f in FIGS. 1, 5 and 6). The low-pressure refrigerant in a gas-liquid two-phase state sent to the usage-side heat exchanger 6 is caused to exchange heat with water or air functioning as a heating source, heated, and caused to evaporate (see point a in FIGS. 1, 5 and 6). The low-pressure refrigerant caused to evaporate in the usage-side heat exchanger 6 is taken back in, via the switching mechanism 3 and the intake pipe 2*a*, to the compression mechanism 2. A cooling operation is performed as above in the air-conditioning device 1.

(6-2) Heating Operation

During a heating operation, the switching mechanism 3 is controlled to the state represented by dotted lines in FIG. 1. The three-way valve 16 is controlled to the second state. The expansion mechanism 5 is subjected to an opening degree adjustment. The first electromagnetic valve 17 and the return valve 19 are controlled to an open state. The second electromagnetic valve 18 is controlled to a closed state. During a heating operation, the second heat exchanger 60 does not function as a heat radiator for the refrigerant compressed by the first compression element 2*c*, and functions, with the first heat exchanger 40, as an evaporator for the refrigerant depressurized in the expansion mechanism 5.

When the compression mechanism 2 is driven with the refrigerant circuit 10 being in the state described above, the low-pressure refrigerant (see point a in FIGS. 1, 7 and 8) is taken in from the intake pipe 2*a* by the compression mechanism 2, first compressed to an intermediate pressure by the first compression element 2*c* on the upstream side, and then discharged into the intermediate refrigerant pipe 8 (more specifically, the first refrigerant pipe 8*a*) (see point b in FIGS. 1, 7 and 8). The intermediate-pressure refrigerant discharged from the first compression element 2*c* is taken in by the second compression element 2*d* connected to the downstream side of the first compression element 2*c* via the three-way valve 16 and the first electromagnetic valve 17 without passing through the second heat exchanger 60 (see point c in FIGS. 1, 7 and 8), and is further compressed. The high-pressure refrigerant compressed by the second compression element 2*d* is discharged from the compression mechanism 2 into the discharge pipe 2*b* (see point d in FIGS. 1, 7 and 8). As with when a cooling operation is performed, the high-pressure refrigerant discharged from the compression mechanism 2 is compressed, by a two-stage compression actuation in the compression elements 2*c*, 2*d*, to a pressure exceeding critical pressure (i.e., critical pressure Pcp at critical point CP shown in FIG. 7). In addition, the high-pressure discharged from the compression mechanism 2 flows into the oil separator 22*a* constituting the oil separation mechanism 22, and accompanying refrigeration oil is separated. The refrigeration oil separated from the high-pressure refrigerant in the oil separator 22*a* is caused to flow into the oil return pipe 22*b* constituting the oil separation mechanism 22, depressurized in the depressurization mechanism 22*c* provided to the oil return pipe 22*b*, then returned to the intake pipe 2*a* of the compression mechanism 2, and then taken back in to the compression mechanism 2. The high-pressure refrigerant discharged from the compression mechanism 2 is sent through the check mechanism 23 and the switching mechanism 3 to the usage-side heat exchanger 6 functioning as a heat radiator for the refrigerant. The high-pressure refrigerant sent to the usage-side heat exchanger 6 is caused to exchange heat with water or air functioning as a cooling source and passing the exterior, caused to release heat, and cooled, in the usage-side heat exchanger 6 (see point f in FIGS. 1, 7 and 8). The high-pressure refrigerant caused to release heat and cooled in the usage-side heat exchanger 6 is sent to the expansion mechanism 5, and is depressurized in the expansion mechanism 5 and turned into a low-pressure refrigerant in a gas-liquid two-phase state (see point e in FIGS. 1, 7 and 8). The low-pressure refrigerant in a gas-liquid two-phase state depressurized in the expansion mechanism 5 is sent to the first heat exchanger 40 functioning as an evaporator for the refrigerant, and also sent, through the return pipe 8*f* and the return valve 19, to the second heat exchanger 60 functioning, with the first heat exchanger 40, as an evaporator for the refrigerant. The low-pressure refrigerant in a gas-liquid two-phase state sent to the first heat exchanger 40 is caused to exchange heat with air functioning as a heating source, heated, and caused to evaporate (see point a in FIGS. 1, 7 and 8). Meanwhile, the low-pressure refrigerant in a gas-liquid two-phase state sent to the second heat exchanger 60 is, in the same manner as in the first heat exchanger 40, caused to exchange heat with air functioning as a heating source, heated, and caused to evaporate (see point a in FIGS. 1, 7 and 8). The low-pressure refrigerant caused to evaporate in the first heat exchanger 40 is taken back in, via the switching mechanism 3 and the intake pipe 2*a*, to the compression mechanism 2, and the low-pressure refrigerant caused to evaporate in the second heat exchanger 60 is taken back in, via the second refrigerant pipe 8*b*, the second electromagnetic valve 18, the three-way valve 16, the fourth refrigerant pipe 8*d*, and the intake pipe 2*a*, to the compression mechanism 2. A heating operation is performed as above in the air-conditioning device 1.

(7) Characteristics 7-1

In the present embodiment, the water guiding fins 70 functioning as water guiding members are disposed between the first heat exchange part 41 and the second heat exchange part 61.

It is thereby possible to fill the gap between the first heat exchange part 41 and the second heat exchange part 61, guide the refrigerant water generated on the first heat exchange part 41 to the second heat exchange part 61 positioned below the first heat exchange part 41, and guide the condensation water to the condensation water storage part. In other words, the drainage performance of the heat exchange unit 4 can be improved. The condensation water can be thereby prevented from accumulating between the first heat exchange part and the second heat exchange part, making it possible to suppress a decrease in the heat exchange efficiency in the first heat exchange part 41.

7-2

In the present embodiment, thermally conductive heat transfer fins are used as the water guiding fins 70. It thereby becomes possible not only to guide the condensation water downwards but also secure a larger heat transfer area and further improve the heat transfer efficiency in the heat exchange unit 4.

In addition, in the present embodiment, fins that are similar to the first wave-shaped fins 44 and the second wave-shaped fins 64 are used as the water guiding fins 70.

It thereby becomes possible to bring the water guiding fins 70 into contact with the first wave-shaped fins 44 of the first heat exchanger 40 and the second wave-shaped fins 64 of the second heat exchanger 60 as described above. Accordingly, the condensation water generated on the first heat exchange part 41 is more readily guided downwards along the water guiding fins 70, and condensation water flowing downwards along the water guiding fins 70 is more readily guided downwards along the second wave-shaped fins 64. The drainage performance of the heat exchange unit 4 can thereby be further improved.

(8) Modification Examples

Although an embodiment of the present invention is described above with reference to the drawings, specific configurations are not limited to the above embodiment, and can be modified without departing from the scope of the invention.

(8-1) Modification Example A

In the above embodiment, a description is given for an instance in which heat exchangers of different size, due to the usage conditions being different, are used as a single heat exchange unit. However, there may be other instances in which a plurality of heat exchangers are used as a single heat exchange unit due to, e.g., a manufacturing problem or the like.

An example is an instance in which the heat exchanger intended for use is relatively large so as to present a problem in terms of work efficiency during manufacture. In such an instance, a plurality of heat exchangers may be used as a single heat exchange unit due to it being more efficient to manufacture a plurality of heat exchangers that are a fraction of the size of the heat exchanger intended for use.

(8-2) Modification Example B

Figure 9:
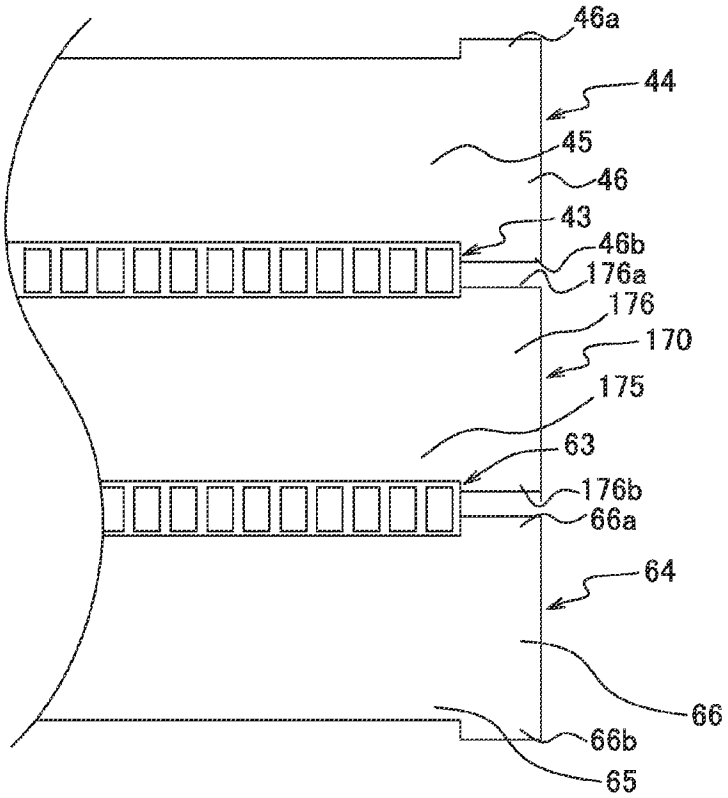
FIG. 9 shows the vicinity of a water guiding fin, including the water guiding fin, according to modification example B as viewed along the longitudinal direction of the flat pipes.

FIG. 9 shows the vicinity of a water guiding fin 170, including the water guiding fin 170, according to modification example B as viewed along the longitudinal direction of the flat pipes 43, 63.

In the above embodiment, it is described that the water guiding fins 70 are in contact with the first wave-shaped fins 44 and the second wave-shaped fins 64. However, it is also possible to use water guiding fins 170 that are not in contact with the first wave-shaped fins 44 and the second wave-shaped fins 64, as shown, e.g., in FIG. 9.

If the water guiding fins 170 are not in contact with the first wave-shaped fins 44 and the second wave-shaped fins 64, an upper edge of an upper edge part 176*a* of each fin fringe part 176 of the water guiding fin 170 is preferably parallel to the lower edge part 46*b* of each of the fin fringe parts 46 of the first wave-shaped fins 44 when viewed along the longitudinal direction of the flat pipes 43, 63, and a lower edge of a lower edge part 176*b* of each of the fin fringe parts 176 is preferably parallel to the upper edge of the upper edge part 66*a* of each of the fin fringe parts 66 of the second wave-shaped fins 64 when viewed along the longitudinal direction of the flat pipes 43, 63, as shown in FIG. 9.

(8-3) Modification Example C

Figure 10:
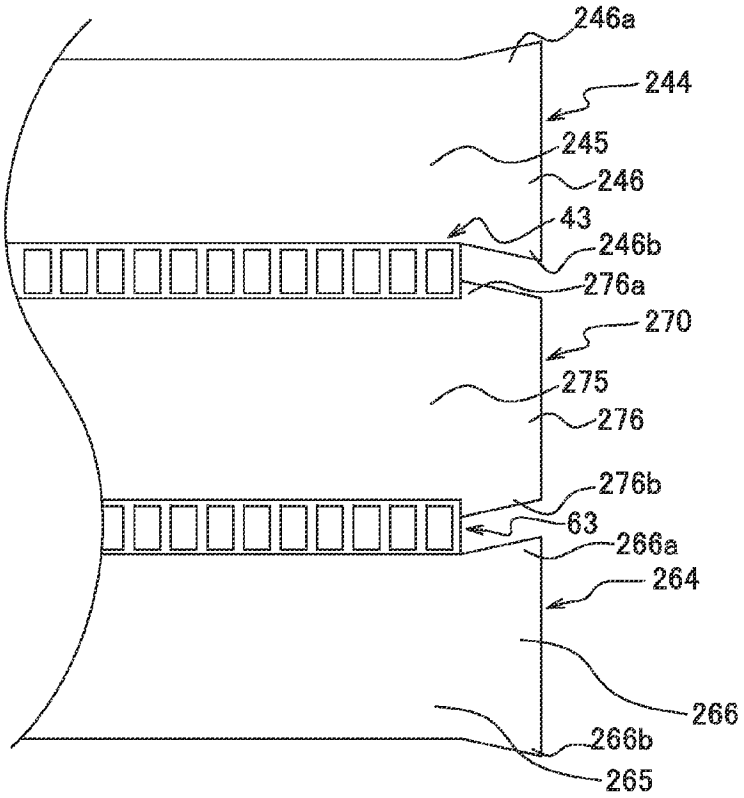
FIG. 10 is a view showing a configuration of a first wave-shaped fin, a second wave-shaped fin, and a water guiding fin according to modification example C.

FIG. 10 is a view showing a different configuration in which first wave-shaped fins 244, second wave-shaped fins 264, and water guiding fins 270 are used instead of the first wave-shaped fins 44, the second wave-shaped fins 64, and the water guiding fins 70.

In the above embodiment, it is described that the fin fringe parts 46, 66, 76 of the first wave-shaped fins 44, second wave-shaped fins 64, and water guiding fins 70 are configured so that the respective upper edge and the lower edge extend in the horizontal direction. However, this is not provided by way of limitation.

For example, as a configurational different to the above embodiment, fin fringe parts 246 of the first wave-shaped fins 244 and fin fringe parts 266 of the second wave-shaped fins 264 may be configured, as shown in FIG. 10, so that when viewed along the longitudinal direction of the flat pipes 43, 63, the respective upper edge and the lower edge spread outwards in the vertical direction (upright direction) from the respective point of contact with a main fin body 245, 265. In other words, when viewed along the longitudinal direction of the flat pipes 43, 63, an upper edge of an upper edge part 246*a* of each of the fin fringe parts 246 and an upper edge of an upper edge part 266*a* of each of the fin fringe parts 266 extend upwards (diagonally upwards) from the respective point of contact with the main fin body 245, 265, and a lower edge of a lower edge part 246*b* of each of the fin fringe parts 246 and a lower edge of a lower edge part 266*b* of each of the fin fringe parts 266 extend downwards (diagonally downwards) from the point of contact with the main fin body 245, 265. In addition, in such an instance, each of the fin fringe parts 276 of the water guiding fins 270 may, as shown in FIG. 10, have a trapezoid shape, in which a main fin body 275 and a bottom portion are in contact with each other, when viewed along the longitudinal direction of the flat pipes 43, 63. In such an instance, when viewed along the longitudinal direction of the flat pipes 43, 63, an upper edge of an upper edge part 276*a* of each of the fin fringe parts 276 is parallel to a lower edge of a lower edge part 246*b* of each of the fin fringe parts 246 of the first wave-shaped fins 244, and a lower edge of a lower edge part 276*b* of each of the fin fringe parts 276 is parallel to an upper edge of an upper edge part 266*a* of each of the fin fringe parts 266 of the second wave-shaped fins 264.

In addition, the first wave-shaped fins 44, the second wave-shaped fins 64, and the water guiding fins 70 may also be fins in which one of the two shapes set forth in the present modification example C is employed as appropriate, or may be an appropriate combination of fins having the two shapes.

(8-4) Modification Example D

In the above embodiment, it is assumed that the respective size of the first right side header and the first left side header, and the respective size of the second right side header and the second left side header, are the same. However, this is not provided by way of limitation.

For example, since the density of the refrigerant at the outlet of the first heat exchanger 40 during a cooling operation is approximately four times the density of the refrigerant at the outlet of the second heat exchanger 60, an arrangement is also possible in which, among the second headers 62 of the second heat exchanger 60, only the second header 62 on the side of the outlet during a cooling operation is larger than the first headers 42. In other words, the size of the first header 42 and the second header 62 on the side of the inlet during a cooling operation may be the same.

INDUSTRIAL APPLICABILITY

The present invention is suited to a variety of potential applications in a heat exchange unit obtained by assembling a plurality of heat exchangers and a refrigeration device in which a plurality of heat exchangers are used as a single heat exchange unit.

What is claimed is:

1. A heat exchange unit, comprising:

a first heat exchanger configured to exchange heat between a refrigerant flowing, in an interior of the first heat exchanger and air passing an exterior of the first heat exchanger, the first heat exchanger having an inlet opening and an outlet opening for the refrigerant;

a second heat exchanger disposed below the first heat exchanger and being configured to exchange heat between the refrigerant flowing in an interior of the second heat exchanger and air passing an exterior of the second heat exchanger, the second heat exchanger being integrated with the first heat exchanger, the second heat exchanger having an inlet opening and an outlet opening for the refrigerant; and a water guiding fin disposed between the first heat exchanger and the second heat exchanger and being configured to guide condensation water generated on the first heat exchanger to the second heat exchanger, the first heat exchanger further having a plurality of first flat pipes arranged vertically and extending along a longitudinal direction, and first heat transfer fins disposed between the first flat pipes and having a dimension along a transverse direction larger than a width of the first flat pipes, the transverse direction being perpendicular to the longitudinal direction, the second heat exchanger further having a plurality of second flat pipes arranged vertically and extending along the longitudinal direction, and second heat transfer fins disposed between the second flat pipes and having a dimension along the transverse direction larger than a width of the second flat pipes, the inlet opening of the first heat exchanger being disposed on a first side of the water guiding fin in the longitudinal direction, the outlet opening of the second heat exchanger being disposed on a second side of the water guiding fin in the longitudinal direction, the water guiding fin including a single flat body that connects the first flat pipe at a lowermost location among the plurality of first flat pipes which are vertically arranged and the second flat pipe at an uppermost location among the plurality of second flat pipes which are vertically arranged, the single flat body having a dimension along the transverse direction larger than the width of the first flat pipes and the width of the second flat pipes, the first heat exchanger further having a first header disposed on each end of the first heat exchanger and extending vertically, the second heat exchanger further having a second header disposed on each end of the second heat exchanger and extending vertically, and the first header and the second header having a different size in the longitudinal direction.

2. The heat exchange unit according to claim 1, wherein the water guiding fin is a heat transfer fin.

3. The heat exchange unit according to claim 2, wherein the water guiding fin is in contact with the first heat transfer fins and the second heat transfer fins.

4. A refrigeration device including the heat exchange unit according to claim 3, the refrigeration device further comprising:

a compressor having a first compression element configured and arranged to compress the refrigerant and a second compression element configured and arranged to further compress the refrigerant compressed by the first compression element, the first compression element being connected to an upstream of the second compression element in the compressor;

an intermediate refrigerant pipe configured and arranged to cause the refrigerant compressed by the first compression element to be taken in by the second compression element; and a switching valve configured and arranged to switch a flow of the refrigerant compressed by the second compression element to switch between a cooling operation and a heating operation;

the second heat exchanger disposed along the intermediate refrigerant pipe such that the second heat exchanger functions during the cooling operation as a heat radiator of the refrigerant compressed in the first compression element and taken into the second compression element, and during the heating operation as an evaporator of the refrigerant compressed by the second compression element; and the first heat exchanger functioning during the cooling operation as a heat radiator of the refrigerant compressed by the second compression element, and functioning during the heating operation, with the second heat exchanger, as an evaporator of the refrigerant compressed by the second compression element.

5. A refrigeration device including the heat exchange unit according to claim 2, the refrigeration device further comprising:

a compressor having a first compression element configured and arranged to compress the refrigerant and a second compression element configured and arranged to further compress the refrigerant compressed by the first compression element, the first compression element being connected to an upstream of the second compression element in the compressor;

an intermediate refrigerant pipe configured and arranged to cause the refrigerant compressed by the first compression element to be taken in by the second compression element; and a switching valve configured and arranged to switch a flow of the refrigerant compressed by the second compression element to switch between a cooling operation and a heating operation;

the second heat exchanger disposed along the intermediate refrigerant pipe such that the second heat exchanger functions during the cooling operation as a heat radiator of the refrigerant compressed in the first compression element and taken into the second compression element, and during the heating operation as an evaporator of the refrigerant compressed by the second compression element; and the first heat exchanger functioning during the cooling operation as a heat radiator of the refrigerant compressed by the second compression element, and functioning during the heating operation, with the second heat exchanger, as an evaporator of the refrigerant compressed by the second compression element.

6. The heat exchange unit according to claim 1, wherein the water guiding fin is in contact with the first heat transfer fins and the second heat transfer fins.

7. A refrigeration device including the heat exchange unit according to claim 6, the refrigeration device further comprising:

a compressor having a first compression element configured and arranged to compress the refrigerant and a second compression element configured and arranged to further compress the refrigerant compressed by the first compression element, the first compression element being connected to an upstream of the second compression element in the compressor;

an intermediate refrigerant pipe configured and arranged to cause the refrigerant compressed by the first compression element to be taken in by the second compression element; and a switching valve configured and arranged to switch a flow of the refrigerant compressed by the second compression element to switch between a cooling operation and a heating operation;

the second heat exchanger disposed along the intermediate refrigerant pipe such that the second heat exchanger functions during the cooling operation as a heat radiator of the refrigerant compressed in the first compression element and taken into the second compression element, and during the heating operation as an evaporator of the refrigerant compressed by the second compression element; and the first heat exchanger functioning during the cooling operation as a heat radiator of the refrigerant compressed by the second compression element, and functioning during the heating operation, with the second heat exchanger, as an evaporator of the refrigerant compressed by the second compression element.

8. A refrigeration device including the heat exchange unit according to claim 1, the refrigeration device further comprising:

a compressor having a first compression element configured and arranged to compress the refrigerant and a second compression element configured and arranged to further compress the refrigerant compressed by the first compression element, the first compression element being connected to an upstream of the second compression element in the compressor;

an intermediate refrigerant pipe configured and arranged to cause the refrigerant compressed by the first compression element to be taken in by the second compression element; and a switching valve configured and arranged to switch a flow of the refrigerant compressed by the second compression element to switch between a cooling operation and a heating operation;

the second heat exchanger disposed along the intermediate refrigerant pipe such that the second heat exchanger functions during the cooling operation as a heat radiator of the refrigerant compressed in the first compression element and taken into the second compression element, and during the heating operation as an evaporator of the refrigerant compressed by the second compression element; and the first heat exchanger functioning during the cooling operation as a heat radiator of the refrigerant compressed by the second compression element, and functioning during the heating operation, with the second heat exchanger, as an evaporator of the refrigerant compressed by the second compression element.

* * * * *